US009863685B2

(12) United States Patent
Boarman

(10) Patent No.: US 9,863,685 B2
(45) Date of Patent: Jan. 9, 2018

(54) MODULAR COOLING AND LOW ENERGY ICE

(71) Applicant: Whirlpool Corporation, Benton Harbor, MI (US)

(72) Inventor: Patrick J. Boarman, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 446 days.

(21) Appl. No.: 13/691,903

(22) Filed: Dec. 3, 2012

(65) Prior Publication Data

US 2014/0150487 A1 Jun. 5, 2014

(51) Int. Cl.

| | |
|---|---|
| ***F25C 5/08*** | (2006.01) |
| ***F25C 1/04*** | (2006.01) |
| *F25D 17/06* | (2006.01) |

(52) U.S. Cl.

CPC ..... *F25C 5/08* (2013.01); *F25C 1/04* (2013.01); *F25C 2400/10* (2013.01); *F25D 17/065* (2013.01); *F25D 2317/061* (2013.01)

(58) Field of Classification Search

CPC ..... F25C 5/08; F25C 1/04; F25D 2317/061; F25D 2400/10; F25D 17/065

USPC ..... 62/137, 349

See application file for complete search history.

(56) References Cited

U.S. PATENT DOCUMENTS

| | | | | |
|---|---|---|---|---|
| 2,513,823 | A | 7/1950 | Shreve | |
| 2,940,276 | A | 6/1960 | Loewenthal | |
| 3,192,726 | A | 7/1965 | Newton | |
| 3,237,415 | A | 3/1966 | Newton | |
| 3,775,992 | A | 12/1973 | Bright | |
| 3,828,568 | A | 8/1974 | Frazier | |
| 3,850,008 | A | 11/1974 | Frazier | |
| 4,003,214 | A | 1/1977 | Schumacher | |
| 4,448,032 | A | 5/1984 | Hibino et al. | |
| 4,487,032 | A | 12/1984 | Speicher | |
| 4,727,720 | A * | 3/1988 | Wernicki | 62/3.63 |

(Continued)

FOREIGN PATENT DOCUMENTS

| | | | |
|---|---|---|---|
| DE | 102010001465 | A1 | 8/2011 |
| DE | 102010042080 | A1 | 4/2012 |

(Continued)

OTHER PUBLICATIONS

EP Search Opinion, EP2738483, dated Feb. 2, 2015.

(Continued)

*Primary Examiner* — Emmanuel Duke

(74) *Attorney, Agent, or Firm* — Nyemaster Goode, P.C.

(57) ABSTRACT

A refrigerator includes a refrigerator cabinet, an ice maker disposed within the refrigerator cabinet, and an ice mold in the ice maker. The ice maker is configured to provide cooling air from a cool air source along a bottom side of the ice mold during freezing of water to make ice. The ice maker is further configured to provide warm air from a warm air source along the bottom side of the ice mold to facilitate harvesting of the ice. The warm air source may be a refrigeration compartment disposed within the refrigerator cabinet. The ice maker may be disposed within the refrigeration compartment or the freezer compartment. The ice maker may be configured to make clear ice. The ice mold may be fixed in place during the harvesting of the ice.

9 Claims, 4 Drawing Sheets

(56) References Cited

U.S. PATENT DOCUMENTS

| | | | | |
|---|---|---|---|---|
| 4,733,539 | A | 3/1988 | Josten | |
| 4,848,102 | A | 7/1989 | Stanfill | |
| 4,903,506 | A | 2/1990 | Delisle | |
| 4,938,030 | A | 7/1990 | Josten | |
| 4,941,902 | A * | 7/1990 | Ruff | 62/532 |
| 4,947,653 | A | 8/1990 | Day | |
| 4,982,574 | A | 1/1991 | Morris | |
| 5,032,157 | A | 7/1991 | Ruff et al. | |
| 5,218,830 | A | 6/1993 | Martineau | |
| 5,794,452 | A | 8/1998 | Black | |
| 6,145,324 | A | 11/2000 | Dolezal | |
| 6,293,107 | B1 | 9/2001 | Kitagawa et al. | |
| 6,412,286 | B1 | 7/2002 | Park et al. | |
| 6,735,959 | B1 | 5/2004 | Najewicz | |
| 6,908,163 | B1 | 6/2005 | Hebeler et al. | |
| 6,951,113 | B1 | 10/2005 | Adamski | |
| 7,266,973 | B2 * | 9/2007 | Anderson | F25C 1/04 62/351 |
| 7,681,406 | B2 | 3/2010 | Cushman et al. | |
| 7,726,148 | B2 | 6/2010 | Martin | |
| 7,752,859 | B2 * | 7/2010 | Lee | F25C 5/187 62/186 |
| 8,037,697 | B2 | 10/2011 | Leclear | |
| 8,240,159 | B2 | 8/2012 | Prabhakar et al. | |
| 2004/0012314 | A1 | 1/2004 | Hay et al. | |
| 2006/0096310 | A1 * | 5/2006 | Lee | F25D 17/06 62/348 |
| 2006/0168983 | A1 | 8/2006 | Tatsui | |
| 2006/0260325 | A1 | 11/2006 | Lin | |
| 2006/0260350 | A1 | 11/2006 | Van Meter | |
| 2006/0266059 | A1 | 11/2006 | Wetekamp et al. | |
| 2008/0059003 | A1 | 3/2008 | Doberstein et al. | |
| 2008/0141699 | A1 | 6/2008 | Rafalovich et al. | |
| 2009/0302724 | A1 | 12/2009 | Allard et al. | |
| 2010/0071384 | A1 | 3/2010 | Lu et al. | |
| 2010/0126185 | A1 | 5/2010 | Cho | |
| 2010/0186429 | A1 * | 7/2010 | Watson | F25C 5/08 62/66 |
| 2010/0326112 | A1 | 12/2010 | Prabhakar | |
| 2011/0000237 | A1 | 1/2011 | Wetekamp | |
| 2011/0000238 | A1 | 1/2011 | Wetekamp | |
| 2011/0162405 | A1 | 7/2011 | Jeong | |
| 2011/0232888 | A1 | 9/2011 | Sasaki | |
| 2011/0252816 | A1 * | 10/2011 | Kulkarni | F25C 5/10 62/81 |
| 2012/0047918 | A1 | 3/2012 | Herrera | |
| 2012/0118001 | A1 | 5/2012 | Mitchell | |
| 2012/0167596 | A1 * | 7/2012 | Krause | F25B 21/04 62/3.2 |
| 2012/0174613 | A1 * | 7/2012 | Park | F25C 5/005 62/320 |

FOREIGN PATENT DOCUMENTS

| | | | | |
|---|---|---|---|---|
| EP | 1517103 | A2 | 3/2005 | |
| EP | 1821051 | A1 | 8/2007 | |
| EP | 2322887 | A2 | 5/2011 | |
| EP | 2444761 | A2 | 4/2012 | |
| JP | 2000161835 | A | 6/2000 | |
| JP | 2003042615 | * | 2/2003 | F25C 1/18 |
| JP | 2003042615 | A * | 2/2003 | |
| JP | 2003042615 | A * | 2/2003 | F25C 1/00 |
| JP | 2006084135 | A | 3/2006 | |
| KR | 20110064738 | A | 6/2011 | |
| WO | 2008130712 | A1 | 10/2008 | |
| WO | 2009072745 | A2 | 6/2009 | |
| WO | 2009078562 | A1 | 6/2009 | |

OTHER PUBLICATIONS

EP Search Opinion, EP2738484, dated Feb. 23, 2015.
EP Search Opinion, EP2738485, dated Feb. 2, 2015.
EP Search Opinion, EP2738496, dated Feb. 2, 2015.
EP Search Opinion, EP2738497, dated Feb. 2, 2015.
DE102010042080 Machine Translation from Espacenet.
DE102010001465 Machine Translation from Espacenet.
Vian, J. et. al, "Development of a Thermoelectric Ice Maker of Fingers Incorporated into a Static Domestic Refrigerator", 5th European Conference on Thermoelectrics, Sep. 10, 2007, pp. 1-6.
European Patent Office, "European Search Report," issued in connection with European Patent Application No. 13173609.2, dated Aug. 29, 2016, 8 pages.
European Patent Office, "European Search Report," issued in connection with European Patent Application No. 13182465.8, dated Dec. 2, 2016, 9 pages.
European Patent Office, "European Search Report," issued in connection with European Patent Application No. 13188928.9, dated Dec. 2, 2016, 8 pages.
European Patent Office, "European Search Report," issued in connection with European Patent Application No. 13188925.5, dated Dec. 14, 2016, 9 pages.
European Patent Office, "European Search Report," issued in connection with European Patent Application No. 13188923.0, dated Dec. 14, 2016, 12 pages.

* cited by examiner

MODULAR COOLING AND LOW ENERGY ICE

FIELD OF THE INVENTION

The present invention relates to refrigerators. More particularly, but not exclusively, the present invention relates to a refrigerator which includes an ice maker.

BACKGROUND OF THE INVENTION

Refrigerators often include ice makers for making ice. The making of ice can be an energy intensive function which can reduce the energy efficiency of the refrigerator. In some refrigerators, ice is made in an ice tray and then the ice removed from the ice tray through a twisting motion applied to the ice tray. Using a motor to provide this twisting motion to the ice tray can be a significant expenditure of energy. One alternative is to use heaters to heat the ice mold in order to release the ice. This is another example of a method which uses high energy. What is needed is improved ways of making ice and removing ice from an ice mold.

SUMMARY OF THE INVENTION

Therefore, it is a primary object, feature, or advantage of the present invention to improve over the state of the art.

It is a further object, feature, or advantage of the present invention to provide for improved methods and apparatuses for making and removing ice from an ice mold of a refrigerator.

It is a further object, feature, or advantage of the present invention to provide for energy efficient removal of ice.

One or more of these and/or other objects, features, or advantages of the present invention will become apparent from the specification and claims that follow. No single embodiment need meet or provide each and every object, feature, or advantage. Different embodiments may have different objects, features, or advantages. The present invention is not to be limited by or to these objects, features, or advantages.

According to one aspect, a refrigerator is provided. The refrigerator includes a refrigerator cabinet, an ice maker disposed within the refrigerator cabinet, and an ice mold in the ice maker. The ice maker is configured to receive cooling air from a cool air source along a bottom side of the ice mold during freezing of water to make ice. The ice maker is further configured to receive warm air from a warm air source along the bottom side of the ice mold to facilitate harvesting of the ice. The warm air source may be a refrigeration compartment disposed within the refrigerator cabinet. The ice maker may be disposed within a refrigeration compartment and may be configured to make clear ice. The ice maker alternatively may be disposed within a freezer compartment. The ice mold may be fixed in place during the harvesting of the ice. A heat exchanger may be operatively connected to the bottom side of the ice mold.

According to another aspect, a refrigerator includes a refrigerator cabinet, a freezer compartment disposed within the refrigerator compartment, a refrigeration compartment disposed within the refrigerator cabinet, an ice maker disposed within the refrigerator cabinet, and an ice mold in the ice maker having a bottom side. The ice maker is configured to receive cooling air along the bottom side of the ice mold during freezing of water to make ice. The ice maker is further configured to warm the bottom side of the ice mold to facilitate harvesting of the ice. The ice maker may be disposed within the refrigeration compartment of the refrigerator. The ice mold may be fixed in place during the harvesting of the ice. The refrigeration compartment may maintain a temperature of above freezing during the freezing of water to make ice by the ice maker. The ice maker may be configured to make clear ice. The ice maker may be configured to warm the bottom side of the ice mold to facilitate harvesting of the ice using warm air. The warm air may be air from the refrigeration compartment. A heat exchanger may be operatively connected to the bottom side of the ice mold. The heat exchanger may include fins.

According to another aspect, a refrigerator is provided which includes a refrigerator cabinet, a freezer compartment disposed within the refrigerator compartment, a refrigeration compartment disposed within the refrigerator cabinet, an ice maker disposed within the refrigerator cabinet, and an ice mold in the ice maker having a bottom side. The ice maker may be configured to cool the bottom side of the ice mold during freezing of water to make ice using cool air. The ice maker may be further configured to warm the bottom side of the ice mold to facilitate harvesting of the ice using warm air. The ice mold may be fixed in place during the harvesting of the ice. The ice maker may be disposed within the refrigeration compartment of the refrigerator or the freezer compartment of the refrigerator. The warm air may be warm air from the refrigeration compartment. A heat exchanger may be operatively connected to the bottom side of the ice mold.

DETAILED DESCRIPTION OF THE PREFERRED EMBODIMENT

Figure 1:
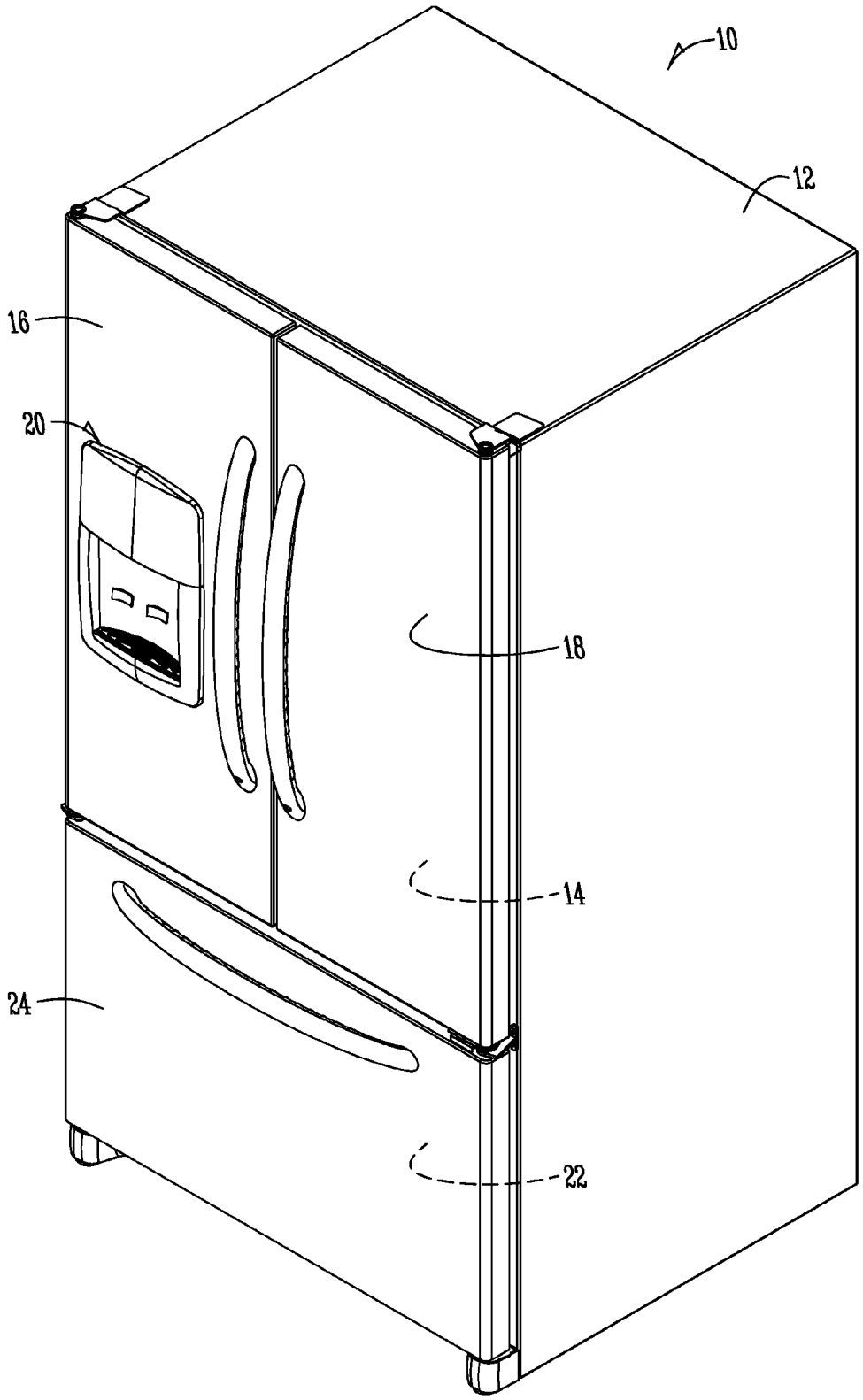
FIG. 1 is a perspective view of one example of a refrigerator of the present invention.

FIG. 1 illustrates one embodiment of a refrigerator of the present invention. In FIG. 1 a refrigerator 10 has a bottom mount freezer with French doors. It is should be understood that the present invention may be used in other configurations including side-by-side refrigerator configurations and other types of configurations, especially where an ice maker and/or ice storage is on a door such as a freezer door or a door providing access to a fresh food compartment. The refrigerator 10 has a housing or refrigerator cabinet 12. One or more compartments are disposed within the refrigerator cabinet 12. As shown in FIG. 1, a fresh food compartment 14 is shown with French doors 16, 18 providing access to the fresh food compartment 14. Mounted on the door 16 is a water and ice dispenser 20. Below the fresh food compartment 14 is a freezer compartment 22 which may be accessed by pulling drawer 24 outwardly.

Figure 2:
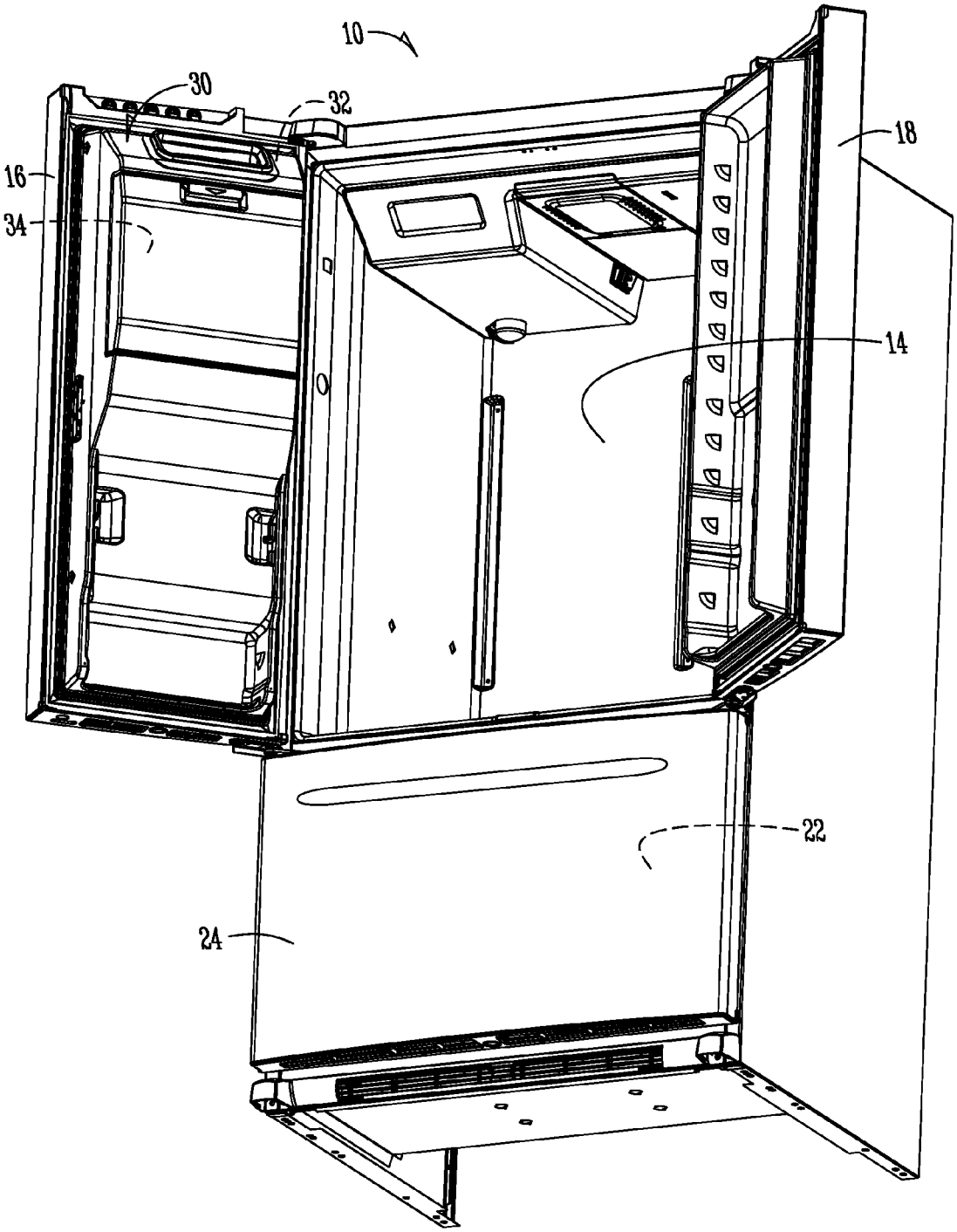
FIG. 2 is a perspective view of the refrigerator of FIG. 1 with the French doors in an open position.

FIG. 2 illustrates the refrigerator 10 of FIG. 1 with French doors 16, 18 in an open position. Mounted on the French door 16 is an ice making compartment 30 in which an ice maker 32 and an ice storage bucket 34 may be disposed. Note the ice making compartment as shown in FIG. 2 is within the refrigeration or fresh food compartment 14. Alternatively, the ice maker 32 may be within the freezer compartment 22. The ice maker 32 may be configured to make either wet or clear ice and/or regular or cold ice. Wet or clear ice is typically made at a higher temperature than regular or cold ice and in a manner to retain clarity of the ice without occlusions. Some consumers consider wet or clear ice to be more desirable than regular ice due to its appearance.

Figure 3:
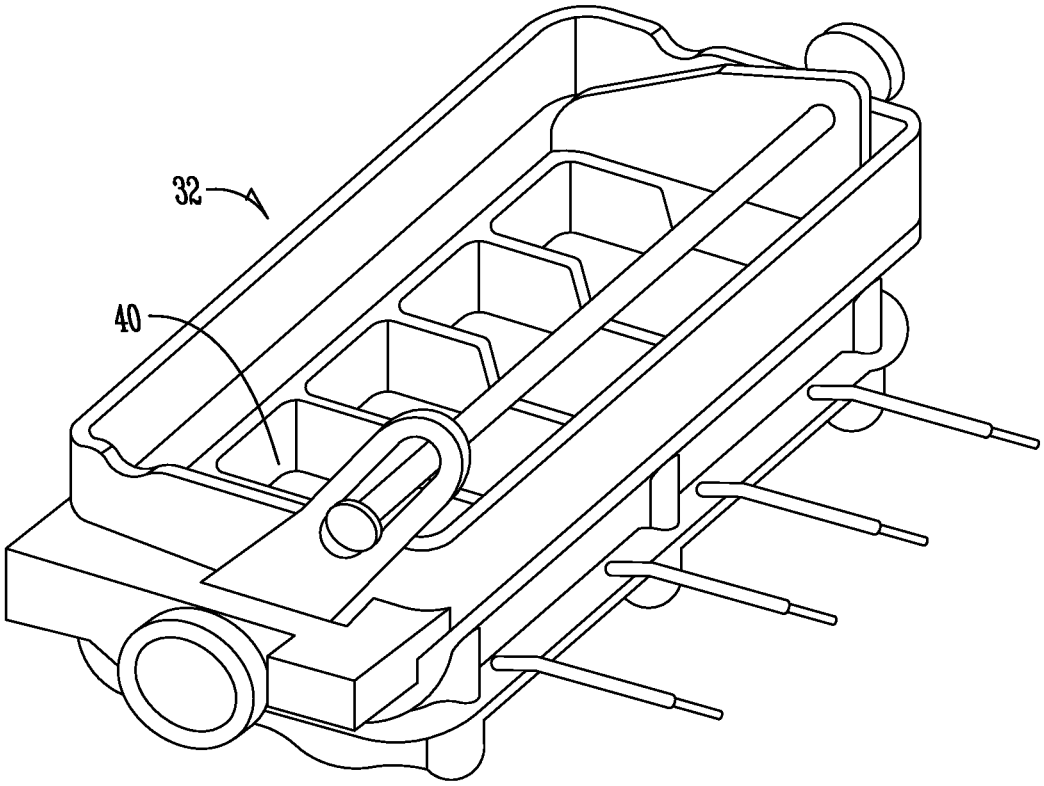
FIG. 3 is a perspective view of one example of an ice maker of the present invention.
Figure 4:
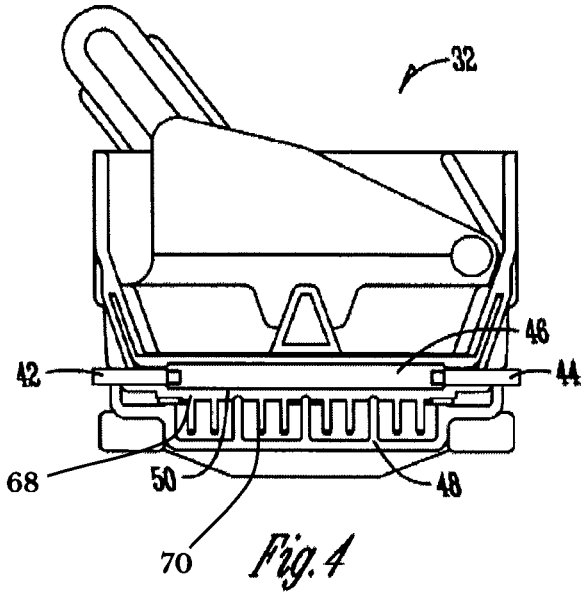
FIG. 4 is an end view of the ice maker of FIG. 3.
Figure 5:
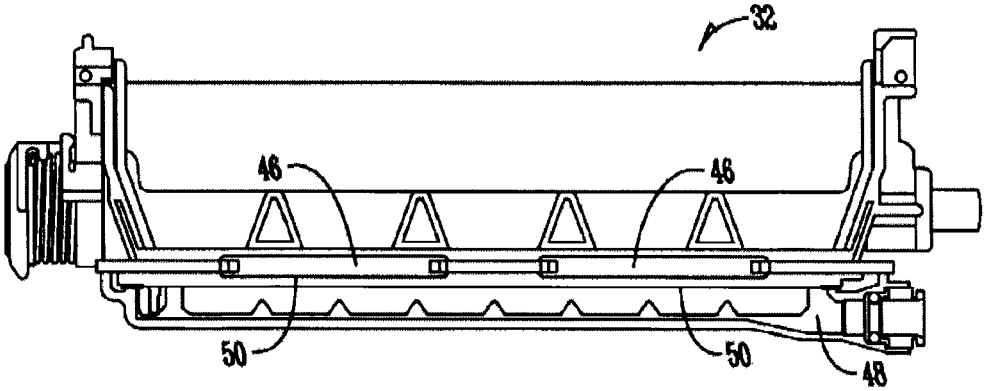
FIG. 5 is a side view of the ice maker of FIG. 3.

FIG. 3 illustrates one example of an ice maker 32 with a fixed ice mold 40. A flex grid 42 is shown for defining space for different ice cubs within the ice mold 40. The ice maker 32 may include a molded tray wall 44. The ice maker 32 allows for heat to be removed using an air cooled system. As best shown in FIG. 4 and FIG. 5, a heat exchanger 68 having fins 70 is present to provide for heat exchange. The fins 70 extend downwardly from the bottom of the ice mold 40 and allow for heat exchange with surrounding air. Thus, cold air can be blown across the fins 70 of the heat exchanger 68 to provide for air cooling of the bottom of the ice mold 40. Thus, the ice maker 32 is configured to provide cooling air from a cool air source along a bottom side of the ice mold 40 during the process of freezing water to make ice. The cool air source may be provided from a number of locations including from the freezer compartment.

To assist in harvesting ice, warm air may be blown across the bottom of the fixed ice mold 40 instead of cold air. The warm air channeling across the bottom side of the ice mold 40 warms the ice mold 40 to assist in separating ice from the ice mold 40. The warm air source may be provided from any number of sources including the refrigerator compartment. Thus, as shown, the ice mold 40 of the ice maker 32 may remain fixed in place both during ice making and during ice harvest. Thus, the energy requirements associated with mechanically twisting the ice mold 40 are avoided. In addition, the use of a heater to melt the ice to assist in ice harvesting is also avoided along with its attendant energy requirements. Moreover, energy savings may be provided when air from the refrigeration compartment or fresh food compartment is used to provide the warm air because this air is then cooled in the process.

Thus, the present invention provides for air cooling to be used in making ice. Air cooling may be used, the cooling may be by air on the bottom side of the ice mold and harvest may be accomplished by warm air channeling across the bottom side of the ice mold. The ice maker may reside in the refrigerator compartment at above freezing temperature, particularly where clear ice is desired. Alternatively, the ice maker may reside in the freezer compartment for normal ice. Note that because the ice mold may be fixed in place during the harvesting of the ice, less energy is needed then in configurations of ice makers where twisting motions are applied to the ice mold during harvesting.

Therefore, a refrigerator which provides for modular cooling and low energy ice in a refrigerator is provided. The present invention contemplates numerous variations including the manner in which the bottom of a mold of an ice maker is cooled, the placement of the ice maker, and other options, variations, and alternatives. In general, the present invention is only intended to be limited by the scope of the following claims.

What is claimed is:

1. A refrigerator comprising: a refrigerator cabinet; an ice maker disposed within the refrigerator cabinet; an ice mold in the ice maker comprising at least one row of at least four ice wells, the at least one row defining a longitudinal axis of the ice mold; a heat exchanger disposed on the bottom side of the icemaker, the heat exchanger comprising a plurality of fins running substantially along the longitudinal axis of the ice mold; the ice maker configured to receive air temperature cooler than temperature of the heat exchanger along a bottom side of the ice mold during freezing of water to make ice; the ice maker further configured to receive warm air blown from a warm air source along the bottom side of the ice mold through the heat exchanger fins, wherein the warm air source is a refrigeration compartment disposed within the refrigerator cabinet; and wherein the air is blown in a direction substantially along the longitudinal axis of the icemaker to facilitate harvesting of the ice.

2. The refrigerator of claim 1 wherein the ice maker is configured to make clear ice.

3. The refrigerator of claim 1 wherein the ice mold is fixed in place during the harvesting of the ice.

4. A refrigerator comprising: a refrigerator cabinet; a freezer compartment disposed within the refrigerator cabinet; a refrigeration compartment disposed within the refrigerator cabinet; an ice maker disposed within the refrigerator cabinet; an ice mold comprising at least one row of at least four ice wells, the at least one row defining a longitudinal axis, the ice mold disposed in the ice maker and having a bottom side; a heat exchanger comprising fins substantially aligned with the longitudinal axis of the ice mold, the heat exchanger disposed on and in thermal communication with the bottom side of the ice mold; the ice maker configured to receive air temperature that is cooler than temperature of the heat exchanger along the bottom side of the ice mold during freezing of water to make ice; the ice maker further configured to warm the bottom side of the ice mold to facilitate harvesting of the ice by blowing warm air from the refrigeration compartment along the bottom side of the ice mold and in a direction defined as substantially along the same direction as the heat exchanger fins; and wherein the ice maker is disposed within the refrigeration compartment of the refrigerator.

5. The refrigerator of claim 4 wherein the ice mold is fixed in place during the harvesting of the ice.

6. The refrigerator of claim 4 wherein the refrigeration compartment maintains a temperature of above freezing during the freezing of water to make ice by the ice maker.

7. The refrigerator of claim 4 wherein the ice maker is configured to make clear ice.

8. A refrigerator comprising: a refrigerator cabinet; a freezer compartment disposed within the refrigerator cabinet; a refrigeration compartment disposed within the refrigerator cabinet; an ice maker disposed within the refrigerator cabinet; an ice mold comprising at least one row of at least four ice wells, the at least one row defining a longitudinal axis of the ice mold, the ice mold disposed in the ice maker and having a bottom side; a heat exchanger comprising fins substantially aligned with the longitudinal axis of the ice mold, the heat exchanger disposed on and in thermal communication with the bottom side of the ice mold, wherein the heat exchanger fins receive air temperature cooler temperature of the heat exchanger during freezing of water and receive air temperature warmer than temperature of the heat exchanger from the refrigeration compartment during harvesting of ice; wherein the ice mold is fixed in place during the harvesting of the ice; and wherein the cool air and the warm air are blown through and substantially in the same longitudinal direction as the heat exchanger fins.

9. The refrigerator of claim 8 wherein the ice maker is disposed within the refrigeration compartment of the refrigerator.

* * * * *